United States Patent [19]

Stone

[11] Patent Number: 4,600,153

[45] Date of Patent: Jul. 15, 1986

[54] CLEANING TOOL

[76] Inventor: Ronald K. Stone, 61 Gocke Pl., St. Louis, Mo. 63114

[21] Appl. No.: 609,143

[22] Filed: May 11, 1984

[51] Int. Cl.[4] ..... F28G 1/16

[52] U.S. Cl. ..... 239/543; 62/303; 165/95; 239/556; 239/560; 239/562

[58] Field of Search ..... 239/548, 556, 557, 560-562, 239/589, 592, 104, 271, 530, 547, 566, 593, 602, 543; 165/95; 62/293, 303; 134/166 R-167 C

[56] References Cited

U.S. PATENT DOCUMENTS

| | | | |
|---|---|---|---|
| 1,571,127 | 1/1926 | Ljungstrom | 165/95 |
| 1,659,459 | 2/1928 | Clarke | 165/95 |
| 2,366,354 | 1/1945 | Robbins | 239/550 |
| 2,623,791 | 12/1952 | Schmitz | 239/589 |
| 2,854,150 | 9/1958 | Shea | 239/556 |
| 3,827,637 | 8/1974 | Stephany | 239/242 |

FOREIGN PATENT DOCUMENTS

| | | | |
|---|---|---|---|
| 1132410 | 9/1982 | Canada | 165/95 |
| 2923465 | 12/1980 | Fed. Rep. of Germany | 165/95 |
| 423613 | 2/1935 | United Kingdom | 239/556 |

*Primary Examiner*—Andres Kashnikow

*Attorney, Agent, or Firm*—Richard G. Heywood

[57] ABSTRACT

A cleaning tool connectable to a pressurized fluid source and forming a plurality of fluidic cleansing jets, comprising an elongated tubular wand having a fluid inlet end and a closed end with a plurality of jet ports formed in an adjacent side wall and constructed and arranged for fluidic discharge in a predetermined pattern.

10 Claims, 5 Drawing Figures

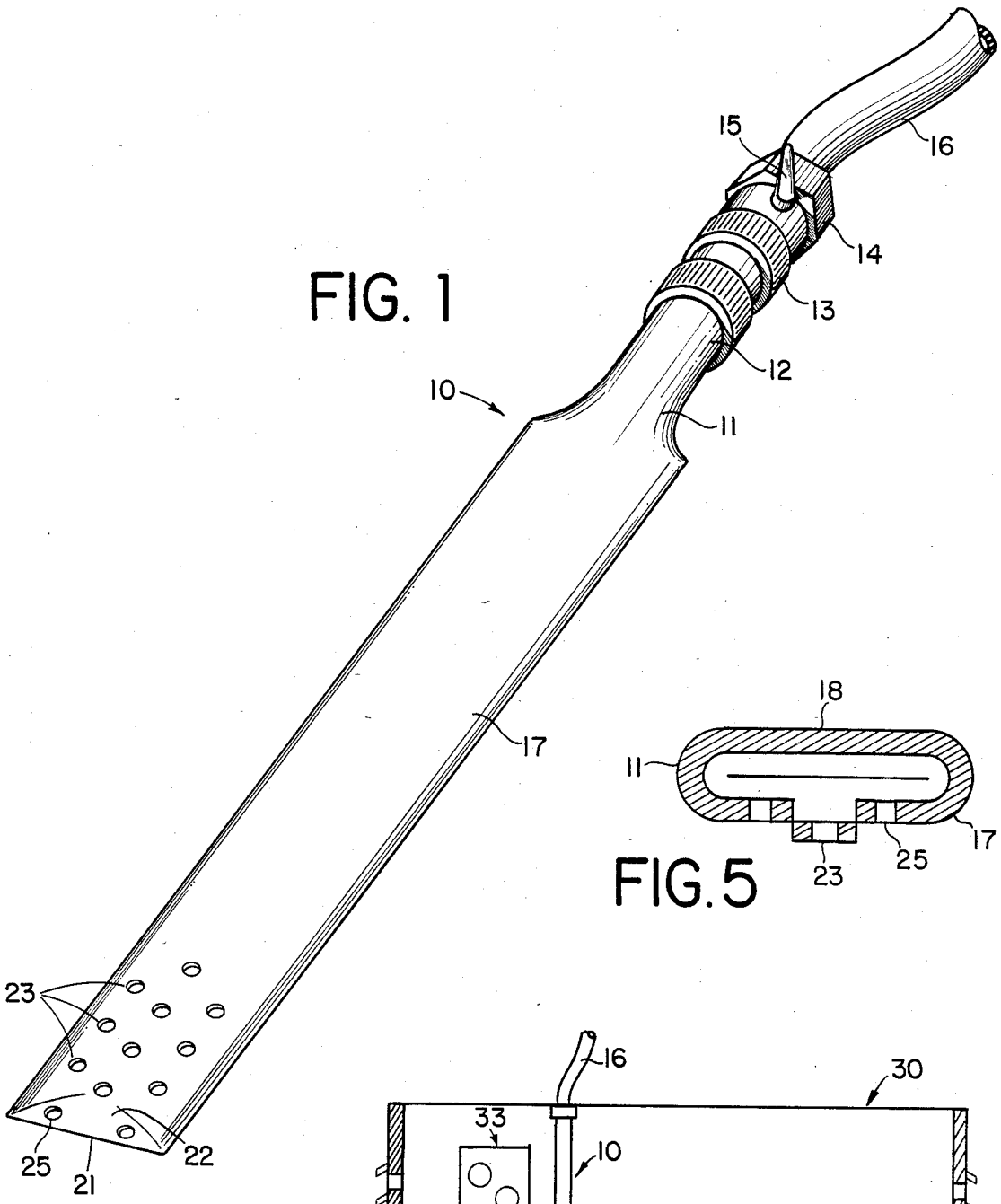
FIG. 1
FIG. 5
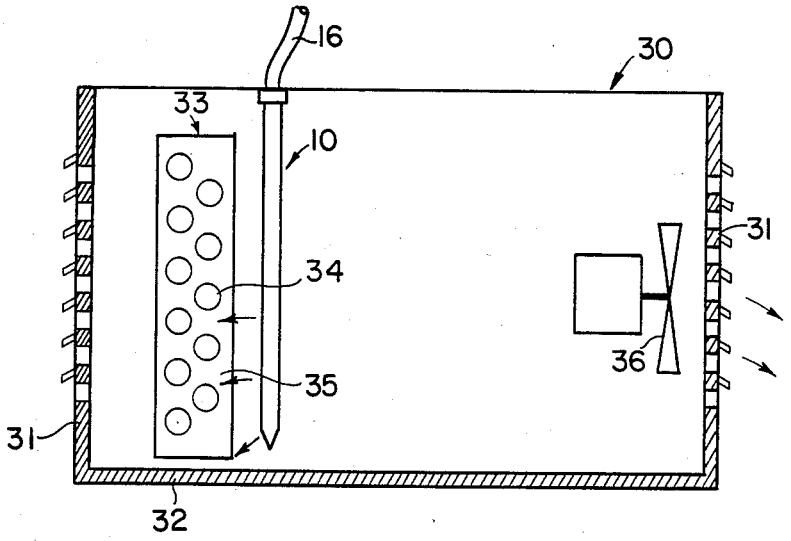
FIG. 2

CLEANING TOOL

BACKGROUND OF THE INVENTION

The present invention pertains generally to cleaning tools, and more particularly to tools for producing controlled high pressure fluidic jets for cleansing action.

It is recognized that a great number of nozzles and tools for producing pressurized cleaning action have been designed in the past for doing a variety of cleaning jobs. One of the most difficult and necessary cleaning tasks is that of air conditioning and refrigeration condenser coils, particularly of the type having closely spaced fins through which air passes to effect heat transfer. Obviously the accumulation of dirt and debris in outdoor condenser units clogs the air passages and coats the fin and coil surfaces and adversely affects the capability for good heat exchange and efficient operation.

Another totally unrelated field is the cleansing of cadavers in the mortuary business, in which thorough "scrubbing" action with a minimum of direct handling or harsh abrasive treatment is desirable.

SUMMARY OF THE INVENTION

The present invention pertains to cleaning tools for producing high or variable intensity fluidic cleansing action and is embodied in a tool having a long, thin body member with a plurality of jet openings for producing predetermined fluidic discharge patterns.

The primary object of the present invention is to provide a simple, strong, durable, economical and efficient cleaning tool having a wide variety of useful applications.

Another object is to provide a cleaning tool having a long, thin, wand-like body member that can easily be handled and manipulated from one end to efficiently effect fluidic jet cleansing from the remote end thereof.

Another object is to provide a simple, yet efficient cleaning tool that is completely portable and connectable to available water sources or other pressurized fluids, and which can be regulated as to fluidic cleaning pressure.

These and still other objects and advantages will become more apparent hereinafter.

DESCRIPTION OF THE DRAWINGS

The invention is embodied in the parts and in the combinations and arrangements or parts hereinafter described and claimed. In the accompanying drawings which form a part of this specification and wherein like numerals refer to like parts wherever they occur:

FIG. 1 is a perspective view of a cleaning tool embodying the present invention, FIG. 2 is a diagrammatic cross-sectional view illustrating a typical cleaning operation with the cleaning tool, FIG. 5 is an enlarged cross-sectional view taken substantially along line 5—5 of FIG. 3.

DESCRIPTION OF THE PREFERRED EMBODIMENT

Figure 3:
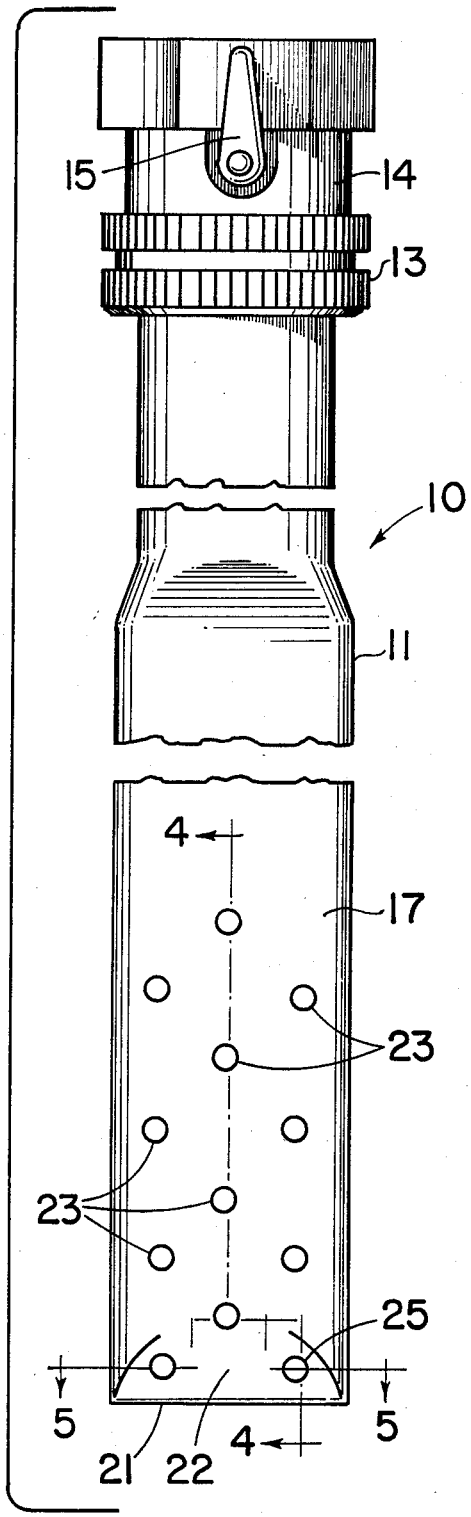
FIG. 3 is an enlarged fragmentary front elevational view of the cleaning tool.
Figure 4:
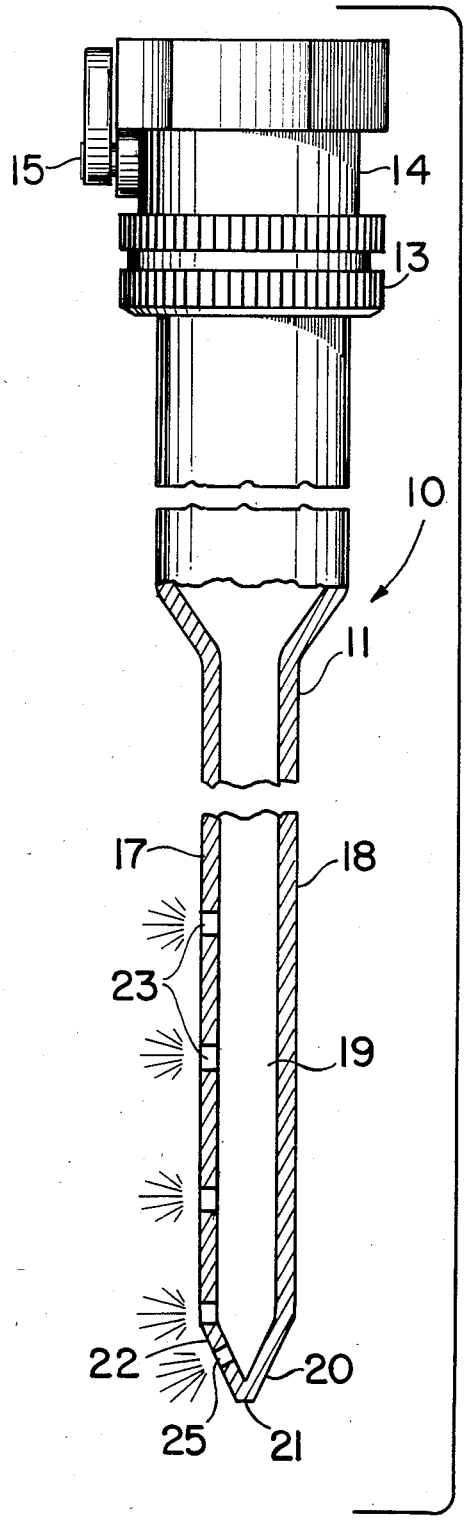
FIG. 4 is an enlarged sectional view taken substantially along line 4—4 of FIG. 3.

Referring now to the drawings wherein a preferred embodiment of a cleaning tool 10 embodying the invention is illustrated, the tool 10 comprises a long main body 11 formed of aluminum conduit or like hollow, tubular material. The body 11 has an open, fluid inlet end 12 with a fitting 13 adapted to connect the tool 10 to a fluid source, and a valve member 14 may be interposed in such connection and has a control handle 15 by which the internal valve (not shown) may be opened or closed to fluid flow or turned to regulate the pressure of such flow. The tool 10 will work efficiently with different fluid cleaning mediums such as compressed air, $CO_2$, and pressurized cleaning fluids such as carbon tetrachloride or the like, but it has been discovered that a conventional city water hookup is highly effective, economical, easy to use and always readily available, as will appear. Thus, the tool 10 through valve 14 may be connected to a typical garden hose 16.

The body 11 of the tool 10 is flattened throughout a major portion of its length so that opposed wall segments 17 and 18 have parallel surfaces and from a constricted interior opening 19 leading to the closed end 20 of the tool thereby creating a venturi-type effect relative to the cross-sectional area of the inlet end 12. The closed end 20 tapers from the flattened wall segments to the sealed margin 21 of the end 20 by convergence of the opposed wall segments to define sloping wall sections 22 angularly related to the parallel flattened segments and thus forms a further constriction of the interior opening at the end. An important feature of the invention resides in the construction and arrangement of jet ports or openings 23 in one of the flattened wall segments (17) and wall sections (22). The aggregate cross-sectional area of the discharge jet openings 23, 25 is less than the cross-sectional area of the constricted interior passage 19 of the tool 10 and thereby forms a final venturi action on the discharge of cleaning fluid therethrough with the effect of increased velocity and decreased pressure. The jet ports 23 are drilled or punched through the side wall 17 and are located in a predetermined pattern having at least three columns of openings and at least two of these columns being offset longitudinally from each other. The thickness of conduit wall 17 is a factor in determining the patterns of jet ports 23 since the fluid passage through the wall will become more directionalized without spreading out if the wall is thicker (and the ports are longer). Therefore, the thicker the conduit material, the closer the ports should be to control convergence of the jet streams. In addition, the lowest or outer jet ports 25 are located in wall section 22 immediately adjacent to the closed end margin and, preferably, are angularly drilled or punched in the wall to direct jet streams in a converging pattern as well as at a downward angle relative to the other jet streams discharged from upper openings 23. This arrangement produces a highly effective and concentrated sweeping or scrubbing action in certain applications, such as cleaning condenser coils as will now be described.

Referring to FIG. 2 of the drawings, a typical air conditioning condenser coil and housing are diagrammatically shown in order to illustrate an operation of the cleaning tool 10. The condenser unit 30 includes a housing having vented side walls 31 and a bottom wall 32, and a top wall closure (not shown). The condensing unit 30 includes a condenser 33 having a serpentine coil 34 and spaced fins 35 providing heat exchange or transfer surfaces, and a fan 36 is provided to move ambient air through the condenser 33 to reduce the temperature of refrigerant in the coil 34 to its saturation temperature as a part of the typical refrigeration cycle. Through prolonged operation of the condensing unit 30, the fan 36 will draw dirt and debris into the housing and, since the air flow is baffled to pass entirely through the condenser 33, the coil 34 and fins 35 will catch or filter this deleterious material and become clogged and coated so that heat transfer efficiency is substantially reduced. The operation of the cleaning tool 10 is as follows. The power to the unit 30 is shut off, the cabinet top is removed and the fan motor is covered and shielded from the water or other cleansing fluid used. The cleaning tool 10 is connected to a pressurized fluid source, such as a city water tap (not shown) and the valve 14 is closed when this supply of water is turned on. It may be noted that the long, thin wand-like construction of the tool 10 creates a reaction force or "kick" at the closed end due to the pressurized jet release. However, the wand construction permits easy control using two hands and the thinness of the tool is important in accessibility to all parts of the coil 34 and fins 35. The tool 10 is moved, starting at the top of the coil, back and forth progressing downwardly to free soil and flush the entire condenser clean. The jet discharge is directed counterflow to normal air flow during condenser operations so that the material is back flushed free rather than being driven into and wedged between fins 35. The jet pattern (23) is predetermined to concentrate the water force on the fin surfaces and the lower or outer converging jets 25 efficiently pre-clean and wash debris downwardly ahead of the direct sweeping motion, and ultimately scrub and flush debris along the bottom wall 32 of the housing where it can be collected and removed.

It is manifest that the cleaning tool 10 is highly efficient and simple in its operation of cleaning surfaces and into cracks and crevices. The special use of this cleaning tool 10 in the mortuary field for cleaning bodies may seem unusual, but is highly efficient with a minimum of effort and distasteful handling. In this application the tool 10 operates better at lower pressures which may be provided by longer holes (23,25) or lowered water pressure. Furthermore, the control valve 14 may be eliminated and a simple slip on/off hose connector (not shown) may be used.

The invention is intended to include all changes and modifications which will be readily apparent to those skilled in the art, and is only limited by the scope of the claims which follow.

What is claimed is:

1. In combination with a refrigeration condenser to be cleaned, a cleaning tool comprising an elongated tubular tool body member having an open end adapted for connection to a pressurized source of cleaning fluid and having a remote closed end, said tool body having a flattened and relatively thin body portion throughout a major portion of its length extending to said closed end thereby forming a constricted hollow interior passage, and a plurality of jet ports formed in said flattened body portion adjacent to said remote closed end including at least two laterally spaced columns of multiple jet openings for producing a predetermined fluidic discharge pattern with convergence of the discharge jet streams for optimum cleansing of the refrigeration condenser.

2. The cleaning tool according to claim 1 in which said open end includes a fitting for connecting said tool body member to the fluid source, said fitting including valve means for controlling the fluidic flow rate into the hollow interior passage of said tool body.

3. The cleaning tool according to claim 1 in which the total cross-sectional area of said discharge openings of said jet ports is less than the cross-sectional area of said hollow interior passage.

4. The cleaning tool according to claim 1, in which said flattened body portion is defined by opposed, substantially parallel wall segments of said tubular tool body, and said columns of multiple jet openings are formed in one of said wall segments.

5. The cleaning tool according to claim 4, in which said remote closed end is tapered by convergence of said opposed wall segments to provide a sloping end wall section angularly related to the parallel wall segments, and at least one jet port being formed in said sloping end wall section to direct a fluidic jet stream angularly downwardly relative to the direction of fluidic discharge from said columns of jet openings.

6. The cleaning tool according to claim 5 in which two laterally spaced jet ports are provided in said sloping end wall section and being angularly formed to discharge converging fluid streams.

7. In combination with a finned refrigeration condenser to be cleaned, a cleaning tool connectable to a pressurized fluid source for producing a plurality of fluidic cleansing jets in a predetermined pattern for cleaning between the fins of the refrigeration condenser, said cleaning tool comprising an elongated hollow body member having an open end and a flattened dimension of constricted cross-sectional area defined by opposed parallel wall segments extending a major portion of said tool length and having a closed end remote from said open end, said open end having a fitting for connection with the fluid source, said closed end being tapered by convergence of said opposed wall segments to provide a sloping wall section angularly related to the flattened parallel wall segments, and at least two columns of closely spaced jet openings being formed in one of said wall segments adjacent to said closed end for discharging fluid jet streams in a converging discharge pattern for cleaning between the fins of the refrigeration condenser, and at least one additional jet port being formed in the sloping wall section.

8. The cleaning tool according to claim 7 in which said open end fitting includes valve means for controlling the fluidic flow rate into said hollow body member from said pressurized fluid source.

9. The cleaning tool according to claim 7 in which two of said jet ports are formed in the sloping wall section of the tapering closed end.

10. The cleaning tool according to claim 7 in which three columns of laterally spaced multiple jet openings are provided, and the openings in at least two of said columns being longitudinally offset from each other.

* * * * *